US011247141B2

(12) United States Patent
Tusacciu

(10) Patent No.: US 11,247,141 B2
(45) Date of Patent: Feb. 15, 2022

(54) MAGNETIC ASSEMBLY

(71) Applicant: Plastwood Italia SRL, Calangianus (IT)

(72) Inventor: Edoardo Pio Tusacciu, Calangianus (IT)

(73) Assignee: Plastwood Italia SRL, Calangianus (IT)

( * ) Notice: Subject to any disclaimer, the term of this patent is extended or adjusted under 35 U.S.C. 154(b) by 0 days.

(21) Appl. No.: 16/774,000

(22) Filed: Jan. 28, 2020

(65) Prior Publication Data

US 2020/0238190 A1 Jul. 30, 2020

(30) Foreign Application Priority Data

Jan. 28, 2019 (IT) ..... 102019000001229

(51) Int. Cl.

| | |
|---|---|
| ***A63H 33/04*** | (2006.01) |
| ***A63H 33/08*** | (2006.01) |
| *A63H 33/26* | (2006.01) |

(52) U.S. Cl.

CPC ..... *A63H 33/046* (2013.01); *A63H 33/08* (2013.01); *A63H 33/26* (2013.01)

(58) Field of Classification Search

CPC ..... A63H 33/08; A63H 33/26; A63H 33/046
USPC ..... 446/92
See application file for complete search history.

(56) References Cited

U.S. PATENT DOCUMENTS 3,183,608 A * 5/1965 Jierree ..... G09B 23/26 434/278
5,048,704 A * 9/1991 Takahashi ..... A63H 17/264 213/75 D
5,362,271 A * 11/1994 Butt ..... A63H 3/36 446/129
5,769,681 A 6/1998 Greenwood, Sr. et al.
(Continued)

FOREIGN PATENT DOCUMENTS

EP 1349626 10/2003
WO WO 02/055168 7/2002
(Continued)

OTHER PUBLICATIONS

European Search Report dated Apr. 30, 2020 From the European Patent Office Re. Application No. 20153527.5. (5 Pages).
(Continued)

*Primary Examiner* — Eugene L Kim
*Assistant Examiner* — Matthew B Stanczak

(57) ABSTRACT

The present invention relates to a magnetic assembly for creating three-dimensional structures, said magnetic assembly comprising at least one ferromagnetic element (1), at least one magnetic element (2), magnetically couplable to said at least one ferromagnetic element (1), and at least one support panel (3) having a perimeter edge (10). Said magnetic assembly being characterised in that it further comprises at least one connection element (4), said at least one connection element (4) comprising a seat (6) for removably housing and retaining a ferromagnetic element (1) or a magnetic element, and at least one peripheral portion (9) suitable for being removably coupled to at least one portion of the perimeter edge (10) of said support panel (3), becoming locked thereto.

22 Claims, 8 Drawing Sheets

(56) References Cited

U.S. PATENT DOCUMENTS 6,749,480 B1 * 6/2004 Hunts ..... A63H 33/046 446/85
7,160,170 B2 1/2007 Yoon
7,465,169 B2 * 12/2008 Roth ..... G09B 23/26 434/278
7,985,116 B2 * 7/2011 Song ..... A63H 33/046 446/92
7,988,518 B2 * 8/2011 Kim ..... A63H 33/08 446/92
8,049,586 B2 * 11/2011 Feng ..... H01F 7/0231 335/285
9,320,980 B2 * 4/2016 Schweikardt ..... A63H 33/046
9,873,061 B2 * 1/2018 Cheung ..... A63H 33/046
10,518,190 B2 * 12/2019 Rosen ..... A63H 33/26
10,717,019 B2 * 7/2020 Eshet ..... A63H 33/084
2001/0021619 A1 * 9/2001 Forkman ..... A63H 17/264 446/129
2005/0118925 A1 * 6/2005 Kretzschmar ..... A63H 33/046 446/124
2005/0118926 A1 * 6/2005 Roger ..... A63H 33/046 446/137
2005/0159076 A1 * 7/2005 Kowalski ..... G11B 5/10 446/137
2006/0014467 A1 * 1/2006 Tusacciu ..... A63H 33/046 446/126
2006/0131989 A1 * 6/2006 Daftari ..... A63H 33/10 310/309
2006/0137270 A1 * 6/2006 Daftari ..... A63H 33/046 52/250
2006/0240737 A1 * 10/2006 Yoon ..... A63H 33/046 446/92
2007/0100468 A1 * 5/2007 Yun ..... A63H 33/046 700/1
2007/0287353 A1 * 12/2007 Vicentelli ..... A63H 33/046 446/92
2008/0200090 A1 * 8/2008 Balanchi ..... A63H 33/046 446/92
2009/0015361 A1 * 1/2009 Tremblay ..... A63H 33/046 335/285
2009/0181595 A1 * 7/2009 Song ..... A63H 33/046 446/92
2009/0197500 A1 * 8/2009 Song ..... A63H 33/046 446/92
2010/0022158 A1 * 1/2010 Kim ..... A63H 33/046 446/92
2010/0075567 A1 * 3/2010 Kim ..... A63H 33/26 446/92
2010/0159794 A1 * 6/2010 Kim ..... A63H 33/046 446/92
2010/0316441 A1 * 12/2010 Vicentelli ..... A63H 33/046 403/300
2013/0109267 A1 * 5/2013 Schweikardt ..... A63H 33/04 446/85
2014/0094083 A1 * 4/2014 Vandoren ..... A63H 33/046 446/92
2014/0213139 A1 * 7/2014 Ferguson ..... A63H 33/046 446/92
2015/0258461 A1 * 9/2015 Balanchi ..... A63H 33/046 446/92
2015/0262744 A1 * 9/2015 Wei ..... H01F 7/02 335/306
2016/0206968 A1 * 7/2016 Choi ..... A63H 33/062
2016/0288008 A1 * 10/2016 Wong ..... A63H 33/046
2017/0095747 A1 * 4/2017 Cheung ..... A63H 33/046
2017/0182429 A1 * 6/2017 Choi ..... A63H 33/046
2017/0216737 A1 * 8/2017 Kiribuchi ..... A63H 33/046
2017/0232357 A1 * 8/2017 Rosen ..... A63H 33/04 446/92
2018/0056204 A1 * 3/2018 Knudsen ..... A63H 33/046
2018/0126294 A1 * 5/2018 Rosen ..... A63H 33/04
2018/0250604 A1 * 9/2018 Keesee, Jr. ..... A63H 9/00
2018/0345156 A1 * 12/2018 Bornstein ..... A63H 1/00
2019/0201804 A1 * 7/2019 Khalus ..... A63H 33/046
2019/0282913 A1 * 9/2019 Lawber ..... A63H 3/46
2020/0238190 A1 * 7/2020 Tusacciu ..... A63H 33/046

FOREIGN PATENT DOCUMENTS

WO WO 2004089496 A1 * 10/2004 ..... A63H 33/04
WO WO 2006/129903 12/2006
WO WO 2009/007829 1/2009

OTHER PUBLICATIONS

Rapporto di Ricerca e Opinione Scritta [Search Report and Written Opinion] dated Oct. 25, 2019 From the Ministero Dello Sviluppo Economico, Direzione Genrale Sviluppo Produttivo e Competitivita, Ufficio Italiano Brevetti e Marchi Re. Application No. IT 201900001229. (8 Pages).

* cited by examiner

MAGNETIC ASSEMBLY

RELATED APPLICATION

This application claims the benefit of priority of Italian Patent Application No. 102019000001229 filed on Jan. 28, 2019, the contents of which are incorporated herein by reference in their entirety.

FIELD AND BACKGROUND OF THE INVENTION

The present invention relates to a magnetic assembly for creating three-dimensional structures.

More precisely, the present invention relates to a magnetic assembly comprising magnetic elements, ferromagnetic elements and support panels which enable three-dimensional geometric grid structures to be created.

Magnetic assemblies that envisage the use of stabilising panels in combination with magnetic and ferromagnetic elements are known in the prior art. One example of such a solution is described in European patent no. EP 1 349 626 B1.

Such magnetic assemblies enable a user, in particular a child, to build grid structures with a complex geometry by means of the magnetic and ferromagnetic elements, thanks to the use of one or more stabilising panels, which allow the structure thus formed to be two-dimensionally stabilised, a structure that would otherwise be flexible. In fact, the panel is fitted between the elements of the grid that delimit it and fills in the space thereof.

However, such panels do not have the function of supporting the structure, and do not enable complex three-dimensional structures extending upwards to be built, since they are not capable of locking the elements of the magnetic assembly in place.

Base panels having a plurality of seats for housing and locking in place elements of a magnetic assembly, for example ferromagnetic spheres, for the creation and support of grid structures by means of the elements of the magnetic assembly are known in the prior art.

One problem of said prior art solution is that the support panels are not sufficiently modular and do not enable complex magnetic structures to be created, since they only allow a vertical extension of the structure relative to their base extent.

In fact, each base has a limited number of seats and only by placing a number of base or support panels next to each other would it be possible to obtain magnetic structures capable of being extended in width. However, this proves to be difficult, since the panels are not capable of being locked to each other. Furthermore, a correct positioning of the base panels such as to enable the formation of magnetic structures depends on the user's ability.

SUMMARY OF THE INVENTION

The aim of the present invention is to overcome the problems of the prior art by developing support panels to be used in combination with magnetic assemblies which enable the construction of complex magnetic structures capable of being extended both in height and in width.

A further aim is to enable greater support, stability and solidity to be imparted to the magnetic structures to be constructed.

Furthermore, another aim is to obtain a modular solution.

The object of the present invention is a magnetic assembly for creating three-dimensional structures, said magnetic assembly comprising at least one ferromagnetic element, at least one magnetic element, magnetically couplable to said at least one ferromagnetic element, at least one support panel having a perimeter edge, said magnetic assembly being characterised in that it further comprises at least one connection element, said at least one connection element comprising a seat for removably housing and retaining a ferromagnetic element or a magnetic element, and at least one peripheral portion suitable for being removably coupled to at least one portion of the perimeter edge of said support panel and being locked thereto.

In particular, according to the invention, the removable coupling between said ferromagnetic element or said magnetic element and the seat of said connection element can be a mechanical coupling.

Moreover, according to the invention, said ferromagnetic element or said magnetic element can have a spherical shape, and said seat of the connection element can have a shape such as to house said spherical element by interlocking.

Again according to the invention, said support panel can have one or more seats, in particular one or more holes, for housing a ferromagnetic element or a magnetic element.

Further according to the invention, said seat of said connection element can have a plurality of teeth shaped so as to facilitate the insertion of said ferromagnetic element or said magnetic element.

Preferably, according to the invention, said seat of said connection element can be a through hole such as to enable the housing of said ferromagnetic element or said magnetic element by one of the two opposing faces of said connection element.

Furthermore, according to the invention, the removable coupling between the peripheral portion of said connection element and said portion of the perimeter edge of said support panel can be a mechanical coupling.

Again according to the invention, at least one portion of the perimeter edge of said support panel can have a lateral slot for inserting the peripheral portion of said connection element therein.

In particular, according to the invention, said peripheral portion of said connection element can be coupled to said lateral slot of said panel by means of a bayonet-like interlock.

More in particular, according to the invention, said lateral slot can be provided between the opposing faces of said support panel, said peripheral portion of said connection element can have at least one portion configured so as to be inserted in said lateral slot between said opposing faces of said support panel.

Further according to the invention, said lateral slot can have at least two protuberances or opposing indentations, each protuberance or indentation being at the inner portion of the opposing faces of the panel, the peripheral portion of said connection element can have an indentation or a protuberance on each of the two opposing faces thereof so that when said peripheral portion of said connection element is inserted into said lateral slot, each protuberance or indentation will interlock with the respective indentation or protuberance.

Furthermore, according to the invention, said support panel can have a polygonal shape, and said lateral slot can be fashioned in at least one corner of said polygonal support panel.

In particular, according to the invention, the lateral slot of the support panel and the peripheral portion of the connection element can have dimensions such that, when the connection element is coupled to the support panel, the geometric centre of the element housed in the connection element substantially coincides, in a top view of the panel, with the vertex of the corner of the panel in which said slot is fashioned.

More in particular, according to the invention, the ferromagnetic element or the magnetic element to be housed in said connection element can have a spherical shape, and the lateral slot of the support panel and the peripheral portion of the connection element can have dimensions such that, when the connection element is coupled to the support panel and the spherical element is housed in said seat of the connection element, the geometric centre of the spherical element substantially coincides, in a top view of the panel, with the vertex of the corner of the panel in which said slot is provided.

Even more in particular, according to the invention, each corner having said lateral slot can be chamfered or broken so as not to interfere with the ferromagnetic element or with the magnetic element when it is disposed in said connection element in turn coupled to the support panel.

Further according to the invention, the element to be housed in said seat of said connection element can be sphere-shaped, moreover, said magnetic assembly might comprise at least one bar-shaped element magnetically couplable to at least one sphere-shaped element, at least one side of said support panel with a polygonal shape can be dimensioned so that when a connection element is coupled at each of two contiguous corners of that side of the panel, the distance between the sphere-shaped elements housed in said two connection elements is equal to the length of a bar-shaped element.

Preferably, according to the invention, said support panel can comprise two half-panels that are removably couplable to each other.

In particular, according to the invention, said half-panels can comprise male-female couplings of a mechanical type.

Moreover, according to the invention, each half-panel can have one or more holes suitable for housing sphere-shaped elements and a clamping means at said holes configured so that when the respective spherical element is disposed at the hole of the inner face of a half-panel, and said half-panels are coupled to each other at the inner faces, said holes of each half-panel will be in a corresponding position and said sphere-shaped elements disposed in said one or more holes will be clamped in place by said clamping means, thus preventing or reducing the rotation thereof.

Preferably, according to the invention, said connection element can have a disc shape.

Again according to the invention, said magnetic element or said ferromagnetic element is a bar.

Finally, according to the invention, said connection element can have one or more openings so that, when a ferromagnetic element or a magnetic element is disposed in the seat of the connection element, said opening will enable the insertion of a magnetic or ferromagnetic element so as to allow the magnetic coupling.

BRIEF DESCRIPTION OF THE SEVERAL VIEWS OF THE DRAWINGS

The invention will now be described by way of illustration and not by way of limitation, with particular reference to the drawings of the appended figures, wherein.

DESCRIPTION OF SPECIFIC EMBODIMENTS OF THE INVENTION

Figure 1:
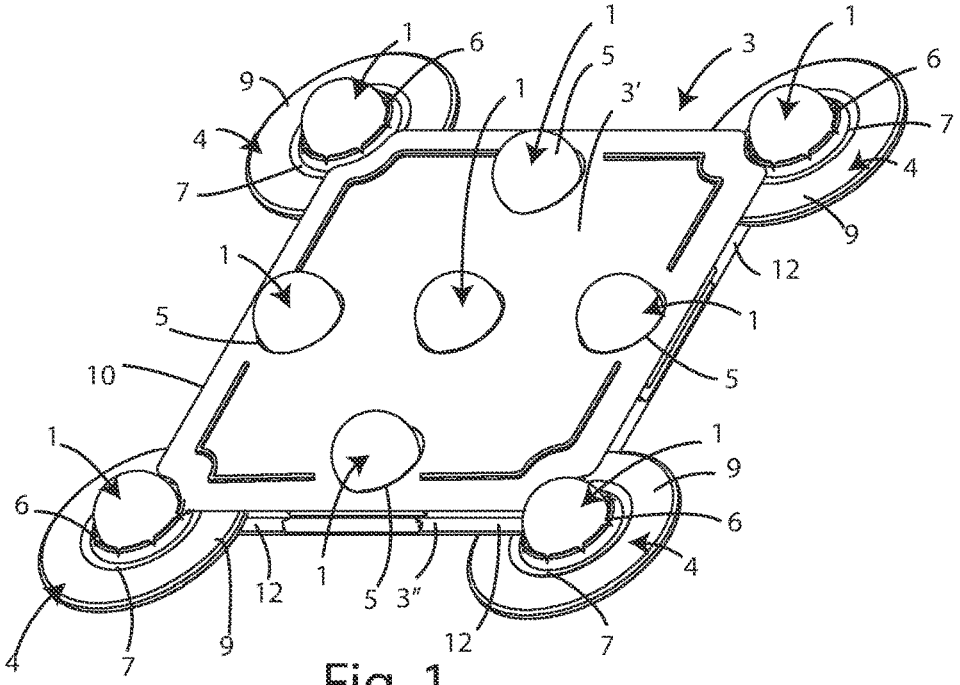
FIG. 1 shows a perspective view of a support panel, four connection elements and nine ferromagnetic spheres of the assembly according to the invention, assembled in a first configuration.

With reference to FIGS. 1-19, one may observe the magnetic assembly according to the invention, whose elements can be assembled in a plurality of configurations, such as the ones shown by way of example in FIGS. 1 and 13-19, in order to create three-dimensional structures.

In particular, said magnetic assemblies can be used as modular construction toys.

The magnetic assembly according to the invention comprises at least one ferromagnetic element 1, at least one magnetic element 2, magnetically couplable to said at least one ferromagnetic element 1, and at least one support panel 3.

The ferromagnetic element 1 in the figures is represented by a ferromagnetic sphere, preferably made of metal, in particular iron. It is evident that in other embodiments the ferromagnetic element can be a solid having a different shape, or a bar with ferromagnetic ends.

In the embodiment shown in the figures, the magnetic element 2 is a bar with magnetic ends, each end being capable of coupling magnetically to a ferromagnetic element of the assembly. In other embodiments, the magnetic element can be a magnetic sphere.

Thanks to the spherical shape of the ferromagnetic element 1 or of the magnetic element, a number of magnetic 2 or ferromagnetic bars can be coupled to a same sphere 1, enabling the creation of complex three-dimensional forms, in particular a geometric grid.

The magnetic assembly according to the invention preferably envisages the use of ferromagnetic or magnetic spheres in combination with magnetic or ferromagnetic bars, whose ends are configured to be coupled magnetically to the spheres.

In particular, bars of two sizes can be provided. A first bar of a first length $l_1$, for example 6.41 cm, and a second bar of a second length $l_2$, for example about 9.59 cm wherein the second length $l_2$ is equal to $$l_2=l_1\cdot\sqrt{2}$$

The support panel 3 has a perimeter edge 10 that delimits a prevalently flat surface having two opposing faces.

As will be seen further below, the support panel 3 can be a single, whole element, or it can be formed by two half-panels 3' and 3" that are removably couplable to each other.

The support panel 3 is preferably made of plastic material, in particular ABS or polypropylene.

The magnetic assembly according to the invention further comprises at least one connection element 4, which comprises a seat 6 for removably housing a ferromagnetic element 1 and retaining it in the seat 6. In other embodiments, not shown, said seat can be suitable for housing the magnetic element, which can be sphere-shaped or bar-shaped.

Furthermore, the connection element 4 has at least one peripheral portion 9 suitable for being removably coupled to at least one portion of the perimeter edge 10 of the support panel 3, becoming locked thereto.

Thanks to the magnetic assembly according to the invention, it is possible to create complex three-dimensional structures (such as the ones shown in FIGS. 13-16), since through the combined use of the support panels 3 and connection elements 4 one obtains bases capable of being extended in width.

In fact, the magnetic assembly according to the invention proves to be particularly modular, since each connection element is capable of being coupled to several support panels and at the same time each support panel is capable of being coupled to several connection elements, acting as a solid base for the creation of three-dimensional structures.

Furthermore, thanks to the solution according to the invention, said support panels 3 and the associated connection elements 4 can also be used to form several levels of the same three-dimensional structure, imparting greater stiffness to the magnetic structure formed from ferromagnetic elements and magnetic elements.

Thanks to the solution according to the invention, the support panels and the connection elements can also be used on the inside of the three-dimensional structure, i.e. not only at the base, to lend solidity thereto and enable it to be moved.

In other embodiments, for example shown in the FIGS. 1-13 and 17, the components of the present invention, in particular the panels and the connection elements, can be used to create modular three-dimensional constructions in assemblies that do not necessarily employ magnetic components. In further embodiments, components of said assembly could comprise only sphere-shaped elements, or sphere-shaped elements and bars couplable to said spheres mechanically, or also bars having at least one spherical end suitable for being housed in the seat of the connection element and/or in the seat of the support panel.

A further object of the present invention can also be an assembly for creating three-dimensional structures, said assembly comprising at least one sphere 1, at least one support panel 3 having a perimeter edge 10, and at least one connection element 4, said at least one connection element 4 comprising a seat 6 for removably housing a sphere 1, and at least one peripheral portion 9 suitable for being removably coupled to at least one portion of the perimeter edge 10 of said support panel 3.

The features of the invention described previously and below apply mutatis mutandis also in the case of a non-magnetic assembly comprising the aforesaid components.

In particular, according to the invention, in the embodiment shown, the removable coupling between the peripheral portion 9 of said connection element 4 and said portion of the perimeter edge 10 of said support panel 3 is a mechanical coupling.

The mechanical coupling enables, on the one hand, a rigid coupling to be created between the components, allowing them to be decoupled only by means of further force exerted by the user, and at the same time it enables a reduction in the use of magnetic components, whose cost has an impact on the final price of the magnetic assembly.

Furthermore, it allows plastic materials to be used for the support panel 3 and for the connection element 4, thus also reducing the weight of the package containing the magnetic assembly.

More particularly, in the embodiment shown in the figures at least one portion of the perimeter edge 10 of said support panel 3 has a lateral slot 12 for the insertion therein of the peripheral portion 9 of said connection element 4. Said lateral slot 12 can be fashioned between the opposing faces of the support panel 3, when it is a single element, or, as in the embodiment shown in the figures, it coincides with an empty space 12 between two half-panels 3' and 3" coupled to each other.

Furthermore, the peripheral portion 9 of the connection element 4 has at least one portion configured so as to be inserted into said lateral slot 12 between said opposing faces or between said half-panels 3', 3" of said support panel 3.

In particular, the slot 12 is tangentially parallel to the flat surface of the support panel 3 and the peripheral portion 9 of the connection element 4, which preferably has a circular shape, in particular a disc shape, and is flat so as to be easily inserted into said lateral slot 12.

Thanks to the solution according to the invention, the coupling between the connection element 4 and the support panel 3 occurs in a direction transversal to the vertical extent of the three-dimensional structure that is constructed. In particular, of the magnetic grid that is constructed between the bars and the spheres, it thus becoming more difficult for the panel and the connection element to become detached from each other inadvertently during the construction of the structure.

In particular, the interlock coupling between the connection element 4 and the support panel 3 is preferably obtained by means of a bayonet-like interlock. As shown specifically in FIGS. 7-9, the lateral slot 12 of the support panel 3 has at least two opposing protuberances 8; each protuberance 8 is at the inner portion of the opposing faces of the support panel 3, in particular at the inner faces of the half-panels 3', 3". Furthermore, as shown in particular in FIGS. 10-12, the peripheral portion 9 of the connection element 4 has an indentation 7 on each of the two opposing faces thereof so that when the peripheral portion 9 of the connection element 4 is inserted into the lateral slot 12, each protuberance 8 interlocks with the respective indentation 7.

In other embodiments, not shown, the protuberances can be fashioned in the peripheral portion of the connection element and the indentations can be fashioned in the lateral slot.

The interlocking between the connection element 4 and the support panel 3 advantageously enables the two elements to be rigidly locked, thereby stiffening the structure and, at the same time, it is easy to decouple by exerting a slight force.

The support panels 3 can have a polygonal shape, preferably a regular polygonal shape, in order that polygonal geometric figures can be constructed. In this case, the lateral slot 12 can be fashioned in at least one corner of said support panel 3. In the embodiment shown in the figures, the panels have a quadrangular shape and the slots 12 are fashioned in each corner.

Figure 17:
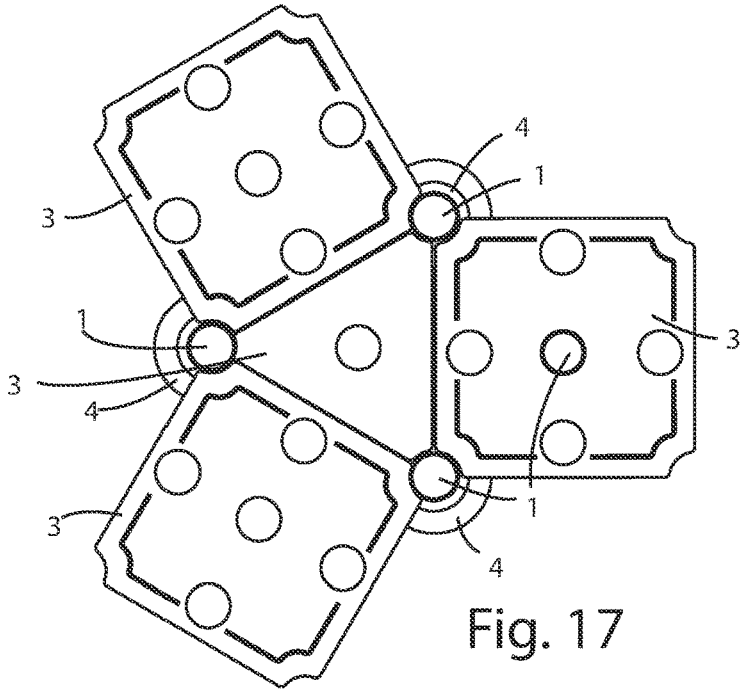
FIG. 17 shows a top perspective view of three support square panels coupled to a support triangular panel by means of three connection elements of the assembly according to the invention, assembled in a sixth configuration.

FIG. 17 shows a support panel 3 that is triangular in shape coupled to three support panels 3 that are square in shape.

The lateral slot 12 of the panel 3 and the peripheral portion 9 of the connection element 4 preferably have dimensions such that, when the connection element 4 is coupled to the panel 3, the geometric centre of the element 1 housed in the connection element 4 substantially coincides, in a top view of the support panel 3, with the vertex of the corner of the panel 3 wherein said slot 12 is fashioned. In particular, when the ferromagnetic or magnetic element 1 is sphere-shaped, said elements are dimensioned so that the geometric centre of the sphere 1 substantially coincides, in a top view of the panel 3, with the vertex of the corner of the panel 3.

Furthermore, when the magnetic assembly according to the invention comprises bars 2 and the connection element 4 is suitable for housing a sphere 1, at least one side of the panel 3 with a polygonal shape is dimensioned so that when a connection element 4 is coupled in each of two contiguous corners of that side of the panel 3, the distance between the spheres 1 housed in said two connection elements 4 will be equal to the length of a bar 2.

If the magnetic assembly according to the invention comprises two bars 2 of two different lengths $l_1$ and $l_2$, as described previously, at least one side of the panel 3 with a polygonal shape is dimensioned so when a connection element 4 is coupled in each of two contiguous corners of that side of the panel 3, the distance between the spheres 1 housed in said two connection elements 4 will be equal to the length of the first bar 2.

Furthermore, each corner of the panel 3 having a lateral slot 12 can be chamfered or broken so as not to interfere with the ferromagnetic element 1 or magnetic element when it is disposed in said connection element 4 in turn coupled to the support panel 3.

Advantageously, the support panel 3 can also have one or more seats 5, in particular one or more holes 5, for housing a ferromagnetic element 1 or a magnetic element. In the embodiment shown in the figures, said seats 5 are suitable for housing respective spheres 1, in particular ferromagnetic spheres 1.

The further seats 5 make it possible to have further anchorage points for the structure to be built.

The panel 3 preferably has a seat 5 disposed at the geometric centre of a face thereof.

In particular, when the panel 3 has a square shape, and the seat 5 is suitable for housing a sphere 1, the panel 3 is dimensioned so that the distance between two spheres 1, each housed in a central seat 5 of two panels 3 coupled at a respective side, corresponds to the length of a bar 2. When the magnetic assembly comprises bars of two lengths, the distance between the two spheres disposed in the respective central seats 5 is preferably equal to the length $l_1$ of the first bar 1.

Again in the case of a panel 3 with a square shape, it can comprise at least a further seat 5 disposed on the panel 3 so that the distance between the sphere 1 housed in said further seat 5 and the sphere housed in a connection element 4 coupled at the vertex of a corner of the panel 3 is equivalent to the length of a bar 2, in particular in the case of bars of two lengths, equivalent to the length $l_1$ of the first bar 1.

In the embodiment shown in the figures, the panel 3 comprises five seats 5 arranged like a cross, with the central seat located at the geometric centre of the square panel 3.

Figure 2:
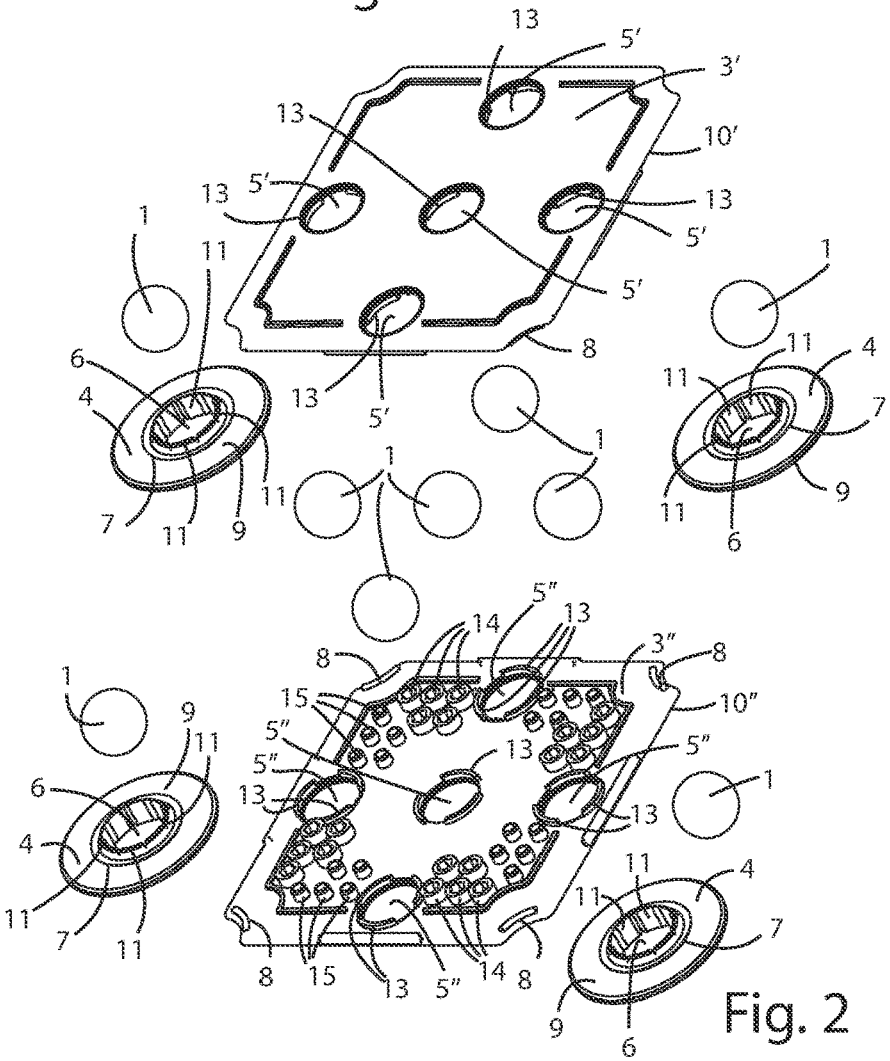
FIG. 2 shows an exploded perspective view of the elements of the assembly of the configuration in FIG. 1.
Figure 3:
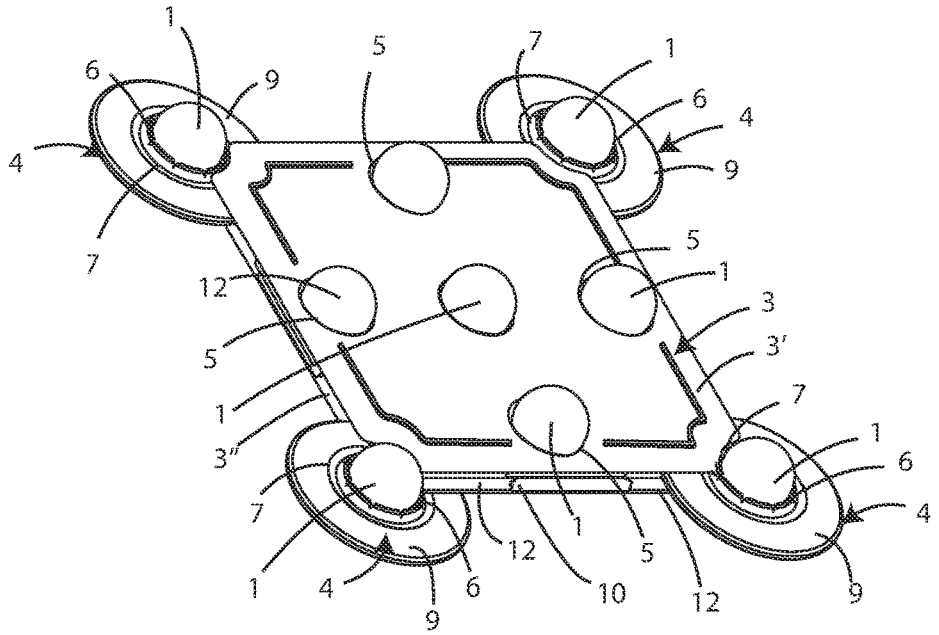
FIG. 3 shows a further perspective view of the configuration in FIG. 1.
Figure 4:
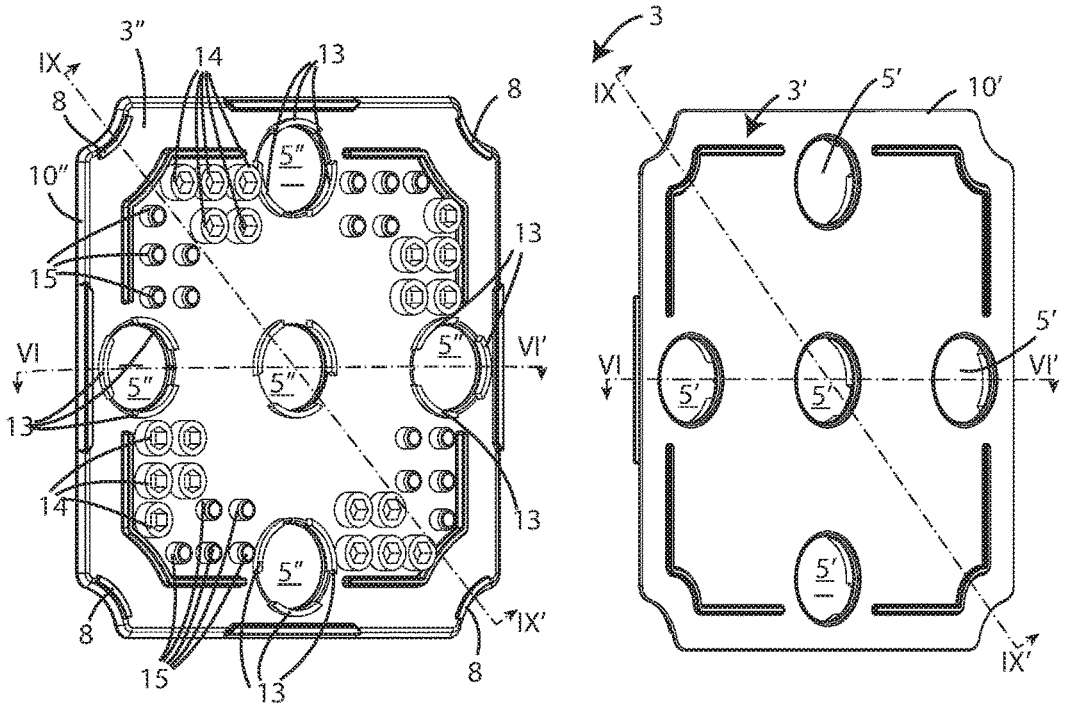
FIG. 4 shows an exploded perspective view of two half-panels making up the support panel of the assembly according to the invention.

As said previously, and with particular reference to FIGS. 2 and 4, the support panel 3 can comprise two half-panels 3' and 3" removably couplable to each other.

This makes it possible to increase the modularity of the solution and reduce production costs. In particular, said half-panels 3' and 3" can be identical.

Each half-panel 3', 3" can comprise male-female couplings 15, 14 of a mechanical type arranged on the inner face so as enable a female 14 male 15 coupling with another half-panel 3", 3'.

Figure 5:
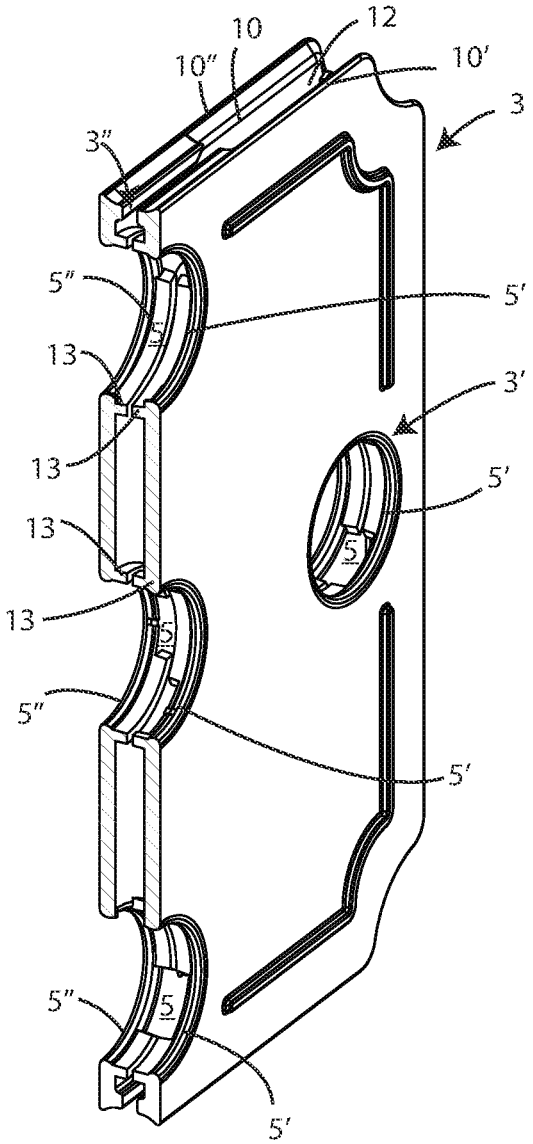
FIG. 5 shows a cutaway perspective view relative to the axis VI-VI' of the assembled half-panels in FIG. 4.
Figure 6:
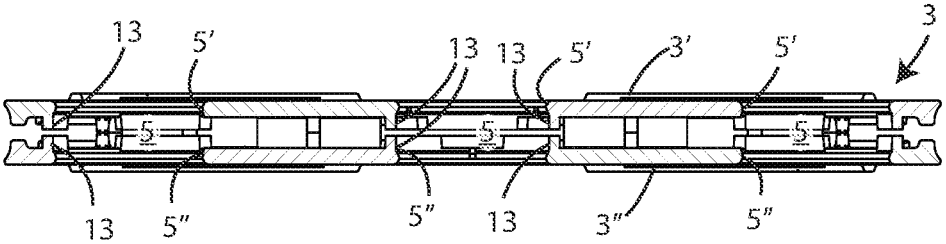
FIG. 6 shows a sectional view along the axis VI-VI' of the assembled half-panels in FIG. 4.
Figure 7:
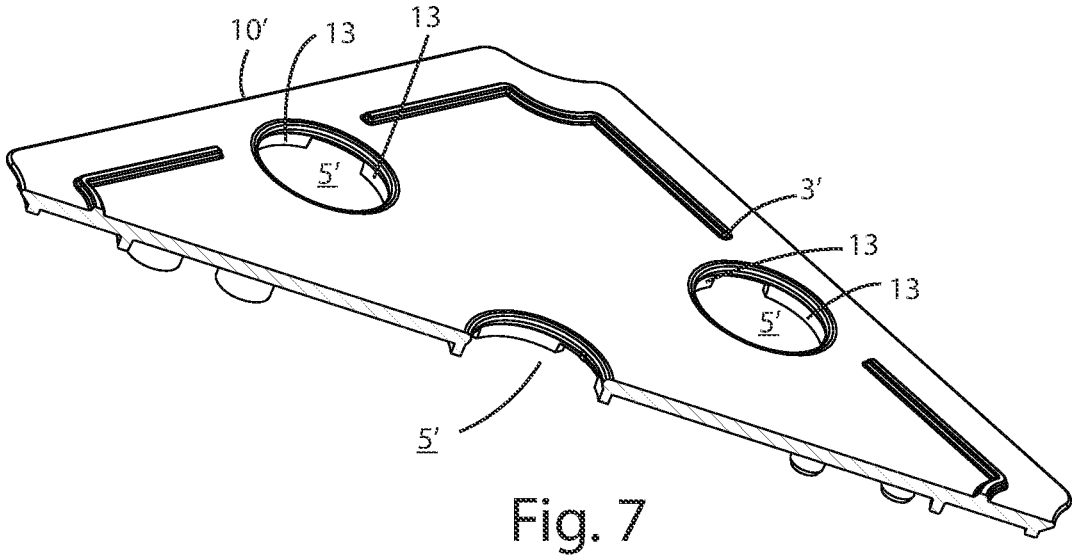
FIG. 7 shows a cutaway perspective view relative to the axis IX-IX' of the second half-panel in FIG. 4.
Figure 8:
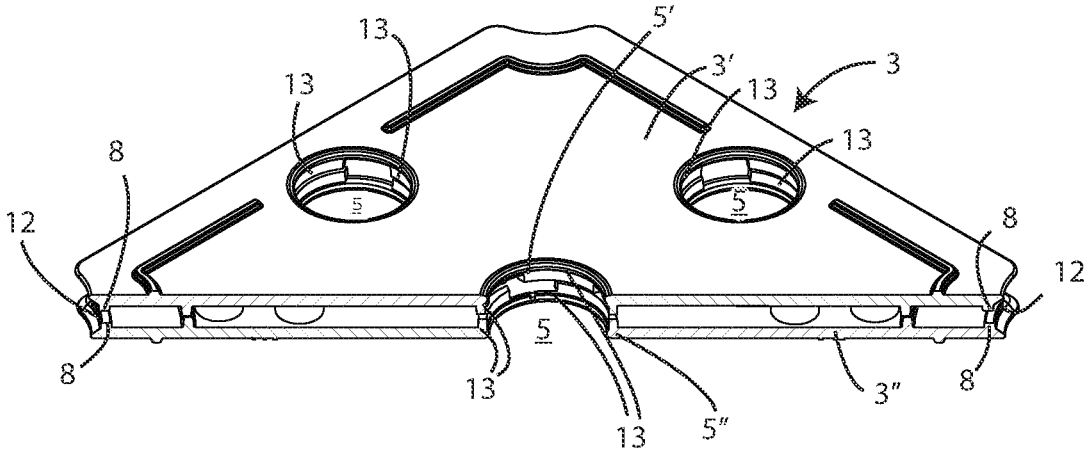
FIG. 8 shows a further cutaway perspective view relative to the axis IX-IX' of the assembled half-panels in FIG. 4.
Figure 9:
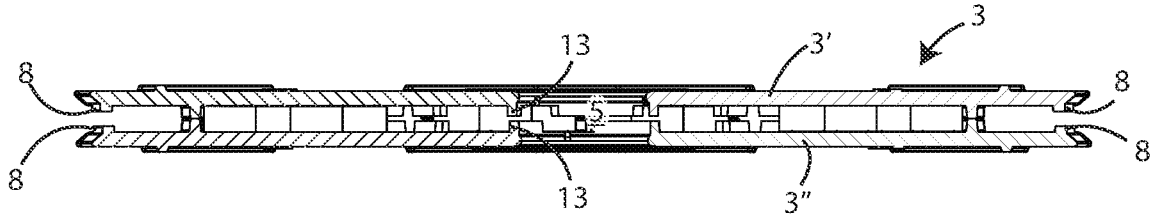
FIG. 9 shows a sectional view along the axis IX-IX' of the assembled half-panels in FIG. 4.

As shown in particular in FIGS. 4-6, when the panel 3 also has seats 5 and consists of two half-panels 3', 3", each half-panel 3', 3" can have one or more holes 5', 5".

When the magnetic assembly according to the invention comprises one or more magnetic or ferromagnetic spheres 1, said holes 5', 5" have a diameter that is smaller than the diameter of said spheres 1 so as keep said spheres in place 1.

Furthermore, each half-panel 3', 3" can have clamping means 13 disposed at said holes 5', 5". Said clamping means 13 are configured so that when the respective ferromagnetic element 1 is disposed in the hole 5' or 5" of the inner face of a half-panel 3' or 3", and said half-panels 3', 3" are coupled to each other on the inner faces, said holes 5', 5" of each half-panel 3', 3" will be in a corresponding position and said spheres 1 disposed in said holes 5', 5" will be clamped into place by said holding means 13. In other words, said clamping means 13 exert a friction force on said spheres 1 so as prevent, or at least reduce, the rotation thereof inside the respective seat 5 during the creation of the three-dimensional structure.

This solution facilitates the construction of complex three-dimensional structures even by less capable users, such as children.

In the particular embodiment, the clamping elements are three tabs 13 suitable for pushing the edge of the sphere 1, when it is housed in said seat 6, towards the opposite side so as to create friction on the surface of the sphere 1 and clamp it in place.

Advantageously, the clamping means renders the structure stiffer and more resistant, since the anchorage points represented by the ferromagnetic elements 1 are irremovably anchored to the support panels 3.

In other words, at the stage of assembly of the two half-panels 3', 3", ferromagnetic elements 1 can be inserted, in particular spheres or balls, which will then be the points of attachment on which to build the three-dimensional magnetic structure, composed, in particular, of bars and spheres.

Only by disassembling the half-panels 3' and 3" from each other will it be possible to remove the ferromagnetic 1 or magnetic elements, or the spheres, clamped thereto.

In the case of whole support panels or panels formed from pre-assembled half-panels, for example ultrasonically welded, the ferromagnetic or magnetic elements can be inserted so as to interlock, for example similarly to the seats of the connection elements.

Moving on to the removable coupling between the ferromagnetic element 1 or the magnetic element and the seat 6 of the connection element 4, it is preferably a mechanical coupling.

In this case as well, the mechanical coupling enables the number of magnetic components to be reduced, thus reducing the assembly costs for the end user and at the same time reducing the weight of the package of the assembly.

In the embodiment shown in the figures, the ferromagnetic element 1 preferably has a spherical geometric shape, and the seat 6 has a shape such as to house said ferromagnetic sphere 1 by interlocking.

Figure 10:
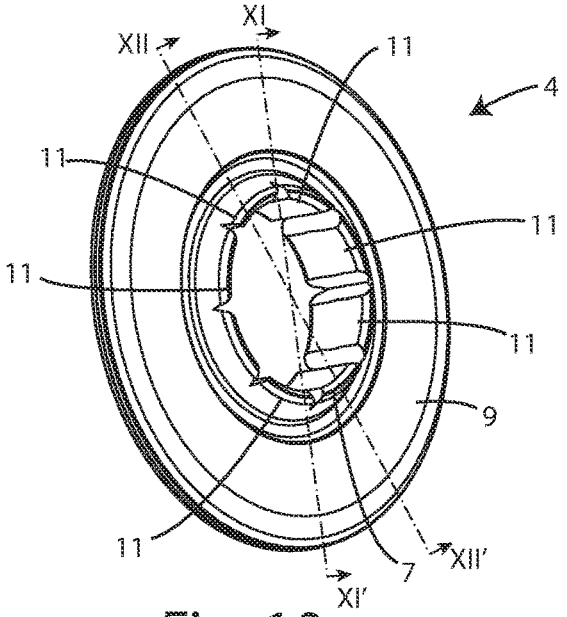
FIG. 10 shows a perspective view in a connection element of the assembly according to the invention.
Figure 11A:
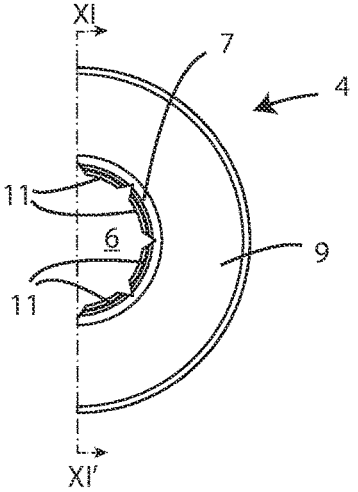
FIG. 11*a* shows a front cutaway view along the axis XI-XI' of the connection element in FIG. 10.
Figure 11B:
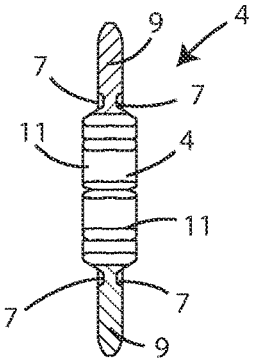
FIG. 11*b* shows a sectional view along the axis XI-XI' of the connection element in FIG. 10.
Figure 11C:
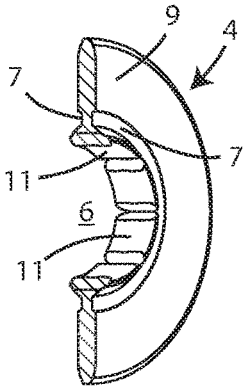
FIG. 11*c* shows a perspective view of FIG. 11*a;*
Figure 12A:
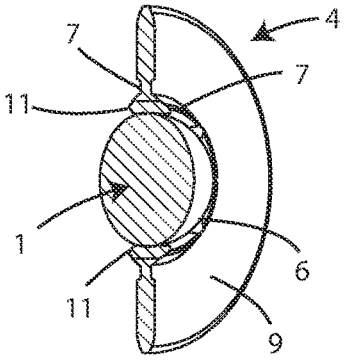
FIG. 12*a* shows a cutaway perspective view along the axis XII-XII' of the connection element in FIG. 10 coupled to a sphere of the assembly according to the invention.
Figure 12B:
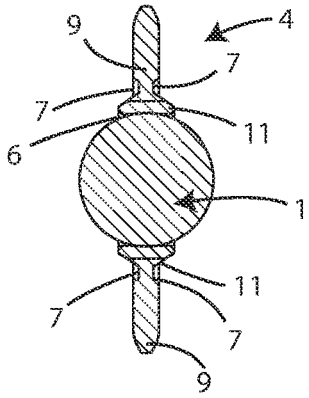
FIG. 12*b* shows a sectional view along the axis XII-XII' of the connection element in FIG. 10 coupled to a sphere of the assembly according to the invention.
Figure 13:
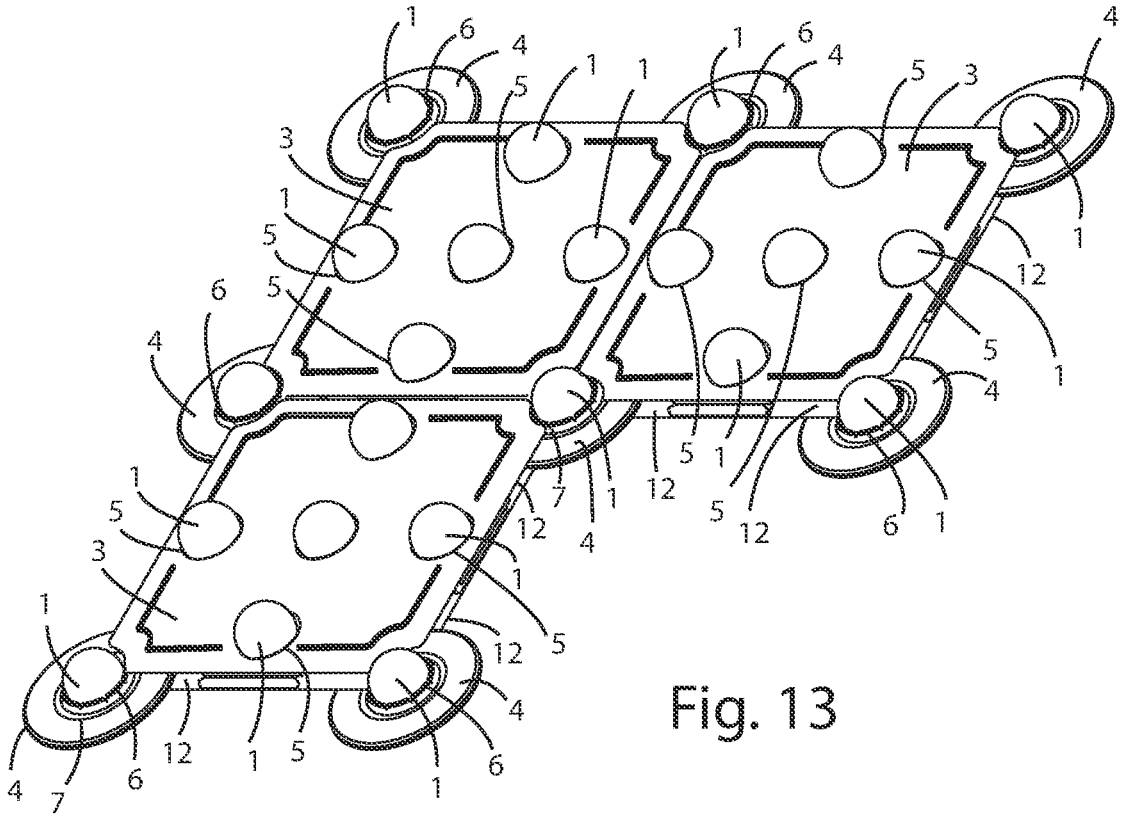
FIG. 13 shows a perspective view of three support panels, eight connection elements, and thirteen spheres of the assembly according to the invention, assembled in a second configuration.
Figure 14:
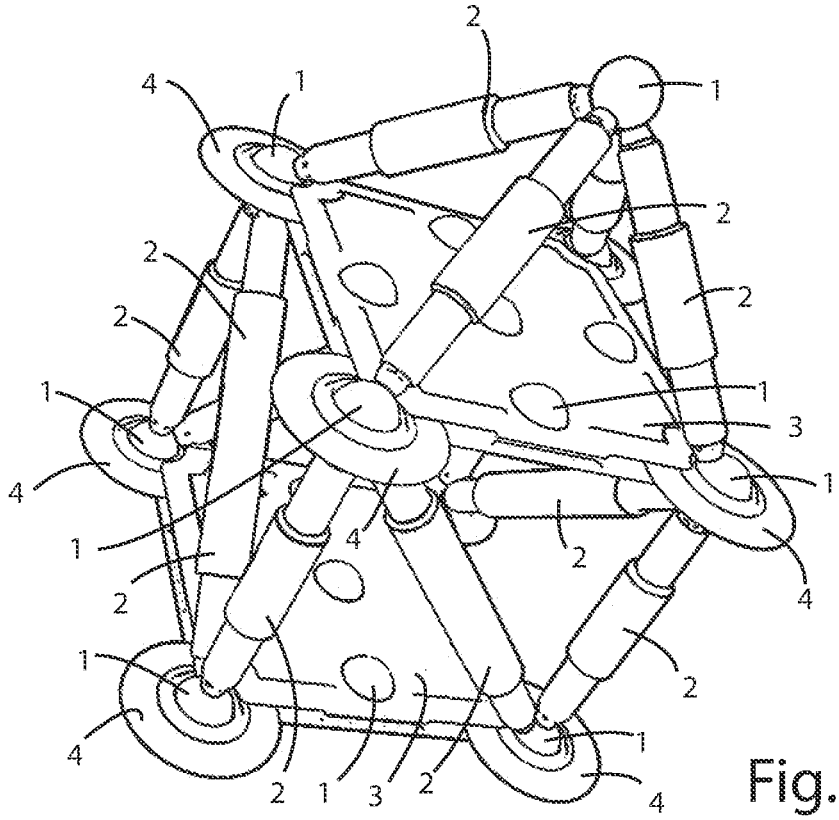
FIG. 14 shows a perspective view of two support panels, eight connection elements, a plurality of spheres and a plurality of bars of the assembly according to the invention, assembled in a third configuration.
Figure 15:
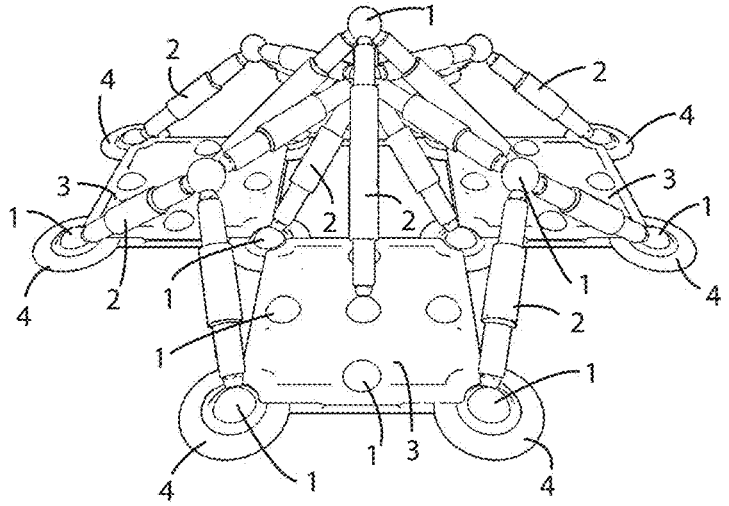
FIG. 15 shows a perspective view of four support panels, twelve connection elements, a plurality of spheres and a plurality of bars of the assembly according to the invention, assembled in a fourth configuration.
Figure 16:
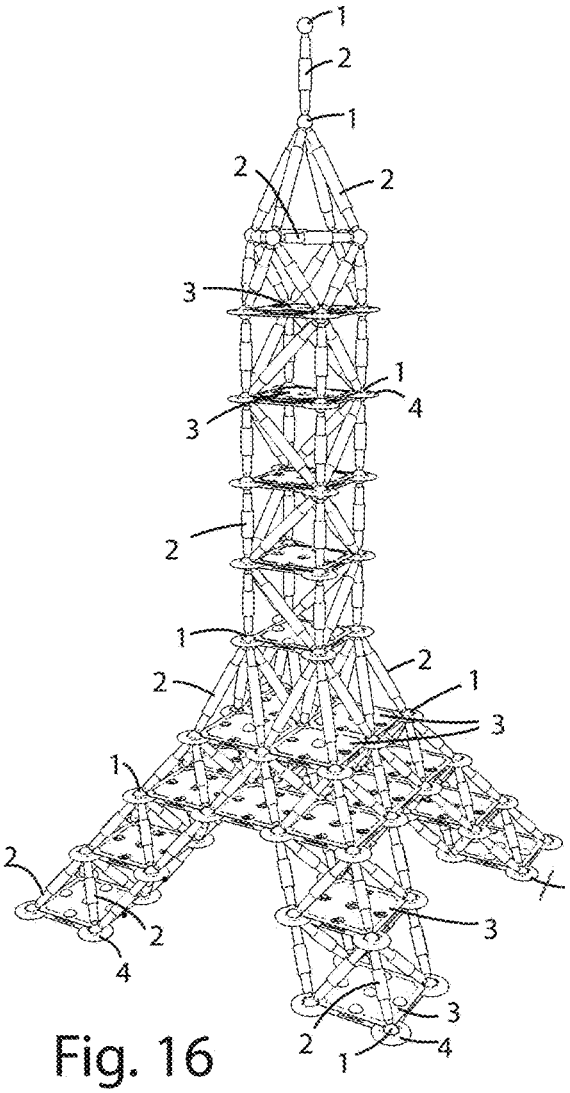
FIG. 16 shows a perspective view of a plurality of support panels, a plurality of connection elements, a plurality of spheres and a plurality of bars of the assembly according to the invention, assembled in a fifth configuration.

With particular reference to FIGS. 10-12, the seat 6 is configured so as to lock said ferromagnetic element 1 or said magnetic element in place. For example, in the case of sphere-shaped elements 1, the diameter of said seat 6 is smaller than the diameter of the sphere 1.

In particular, in the case of sphere-shaped elements to be housed in said seat 6, the connection element 4 can have a plurality of teeth 11 at said seat 6 to facilitate the insertion of the sphere 1, decrease the pressure necessary to insert the sphere 1, and lend flexibility to the hole of the seat 6.

Said teeth 11 preferably have a curved section where they meet the surface of the sphere 1.

Advantageously, the seat of the connection element 6 can be a through hole 6 such as to enable said ferromagnetic element 1 or said magnetic element, for example sphere-shaped, to be housed by one of the two opposing faces of said connection element 4.

This, advantageously, makes it possible to create magnetic couplings between the ferromagnetic and magnetic elements on both faces of the support panels 3.

Figure 18:
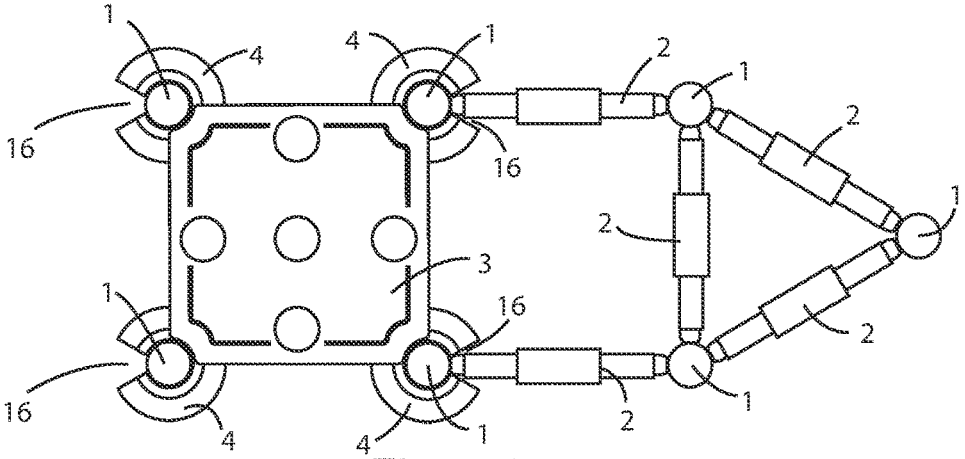
FIG. 18 shows a top perspective view of a support panel coupled to four connection elements having an opening for coupling to bars and spheres of the assembly according to the invention, assembled in a seventh configuration.
Figure 19:
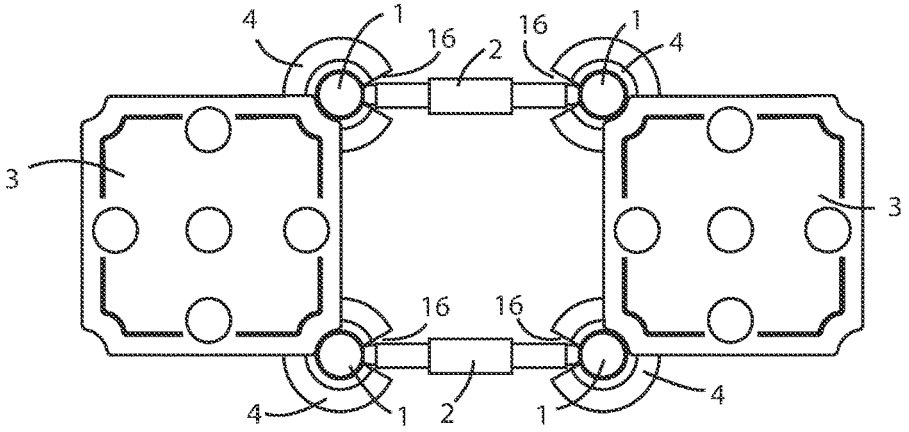
FIG. 19 shows a top perspective view of two support panels coupled to each other by means of four connection elements having an opening for coupling to bars and spheres of the assembly according to the invention, assembled in an eighth configuration.

As shown in the embodiments of FIGS. 18 and 19, the connection element 4 can have one or more openings 16 so that, when a ferromagnetic element 1 or a magnetic element, preferably a sphere-shaped element 1, is disposed in the seat 6 of the connection element 4, said opening 16 enables the insertion of a magnetic element 2 or a ferromagnetic element, preferably a bar-shaped element 2, in order to allow the magnetic coupling.

For example, the disc-shaped connection element 4, can have a split 16, which would enable the insertion of a magnetic bar set coplanarly to the panel, rather than only transversely thereto.

Furthermore, it would make it possible, for example in the case of the embodiment in FIG. 18, to join to a three-dimensional structure formed solely from magnetic elements, or, as in the case of FIG. 19, to join two three-dimensional structures each formed by the connection elements and support panels.

In conclusion, the magnetic assembly according to the invention has the following advantages:

- ease of use for small children and beginners, since the support panels render the structure stiffer, thus facilitating construction;
- the components with mechanical couplings, panels and connection elements enrich the magnetic toy, enhancing the playability thereof;
- it enables more possible angles to be obtained given the possibility of having several points of attachment and thus more ferromagnetic spheres to which to attach the magnetic bars;
- lightweight but very sturdy constructions are obtained;
- there are savings in terms of cost, because fewer magnetic bars are used to obtain similar constructions.

In the foregoing, the preferred embodiments have been described and variants of the present invention have been suggested, but it is to be understood that a person skilled in the art may introduce modifications and changes without going outside the scope of protection, as defined by the appended claims.

What is claimed is:

1. A magnetic assembly for creating three-dimensional structures, said magnetic assembly comprising at least one ferromagnetic element (1), at least one magnetic element (2), magnetically couplable to said at least one ferromagnetic element (1), and at least one support panel (3) having a perimeter edge (10) that delimits a prevalently flat surface having two opposing faces, wherein at least one portion of the perimeter edge (10) of said support panel (3) has a lateral slot (12) which is tangentially parallel to the flat surface of the support panel (3), wherein said magnetic assembly further comprises at least one connection element (4), said at least one connection element (4) comprising a seat (6) for removably housing and retaining a ferromagnetic element (1), and at least one peripheral portion (9) which is flat and suitable for being inserted into said lateral slot (12) of at least one portion of the perimeter edge (10) of said support panel (3), so that it is tangentially parallel to the flat surface of the support panel (3), and being removably coupled to it so that it is locked thereto, wherein said seat (6) of said connection element (4) is a through hole (6), such as to enable said ferromagnetic element (1) to be housed by one of the two opposing faces of said connection element (4).

2. The magnetic assembly according to claim 1, wherein said ferromagnetic element (1) has a spherical shape, and in that said seat (6) of the connection element (4) has a shape such as to house said spherical element (1) by interlocking.

3. The magnetic assembly according to claim 1, wherein said support panel (3) has one or more seats (5), in particular one or more holes (5), for housing a ferromagnetic element (1).

4. The magnetic assembly according to claim 1, wherein said peripheral portion (9) of said connection element (4) is coupled to said lateral slot (12) of said panel (3) by means of a bayonet-like interlock.

5. The magnetic assembly according to claim 1, wherein said lateral slot (12) is fashioned between the opposing faces (3', 3") of said support panel (3), and in that said peripheral portion (9) of said connection element (4) has at least one portion configured so as to be inserted into said lateral slot (12) between said opposing faces (3', 3") of said support panel (3).

6. The magnetic assembly according to claim 5, wherein said lateral slot (12) has at least two protuberances (8), each protuberance (8) being at the inner portion of the opposing faces (3', 3") of the panel (3), and in that the peripheral portion (9) of said connection element (4) has an indentation (7) on each of the two opposing faces thereof so that when said peripheral portion (9) of said connection element (4) is inserted into said lateral slot (12), each protuberance (8) interlocks with the respective indentation (7).

7. The magnetic assembly according to claim 1, wherein said support panel (3) has a polygonal shape, and in that said lateral slot (12) is fashioned in at least one corner of said polygonal support panel (3).

8. The magnetic assembly according to claim 7, wherein the lateral slot (12) of the support panel (3) and the peripheral portion (9) of the connection element (4) have dimensions such that, when the connection element (4) is coupled to the support panel (3), the geometric center of the element (1) housed in the connection element (4) substantially coincides, in a top view of the panel (3), with the vertex of the at least one corner of the panel (3) wherein said slot (12) is fashioned.

9. The magnetic assembly according to claim 8, wherein the at least one corner having said lateral slot (12) is chamfered or broken so as not to interfere with the ferromagnetic element (1) when it is disposed in said connection element (4) in turn coupled to the support panel (3).

10. The magnetic assembly according to claim 7, wherein the element (1) to be housed in said seat (6) of said connection element (4) is sphere-shaped, in that it comprises at least one bar-shaped element (2) magnetically couplable to at least one sphere-shaped element (1), and in that at least one side of said support panel (3) with a polygonal shape is dimensioned so that when a connection element (4) is coupled in the at least one corner, the distance between the sphere-shaped elements (1) housed in said two connection elements (1) is equal to the length of a bar-shaped element (2).

11. The magnetic assembly according to claim 1, wherein said support panel (3) comprises two half-panels (3', 3") that are removably couplable to each other.

12. The magnetic assembly according to claim 11, wherein each half-panel (3', 3") has one or more holes (5', 5") suitable for housing sphere-shaped elements (1) and clamping means (13) at said holes (5', 5") configured so that when the respective spherical element (1) is disposed at the hole (5'; 5") of the inner face of a half-panel (3'; 3"), and said half-panels (3', 3") are coupled to each other on the inner faces, said holes (5', 5") of each half-panel (3', 3") will be in a corresponding position and said sphere-shaped elements (1) disposed on said one or more holes (5', 5") will be clamped in place by said clamping means (13), thus preventing or reducing the rotation thereof.

13. The magnetic assembly according to claim 11, wherein said half-panels (3'; 3") comprise male-female couplings of a mechanical type.

14. The magnetic assembly according to claim 1, wherein said connection element (4) has a disc shape.

15. The magnetic assembly according to claim 1, wherein said connection element (4) has one or more openings (16) so that, when a ferromagnetic element (1) is disposed in the seat (6) of the connection element (4), said opening (16) enables the insertion of a magnetic element (2) or a ferromagnetic element to allow the magnetic coupling.

16. The magnetic assembly according to claim 1, wherein the removable coupling between said ferromagnetic element (1) and the seat (6) of said connection element (4) is a mechanical coupling.

17. The magnetic assembly according to claim 1, wherein said seat (6) of said connection element (4) has a plurality of teeth (11) shaped so as to facilitate the insertion of said ferromagnetic element (1).

18. The magnetic assembly according to claim 1, wherein the removable coupling between the peripheral portion (9) of said connection element (4) and said portion of the perimeter edge (10) of said support panel (3) is a mechanical coupling.

19. The magnetic assembly according to claim 1, wherein the ferromagnetic element (1) to be housed in said connection element (4) has a spherical shape, and the lateral slot (13) of the support panel (3) and the peripheral portion (9) of the connection element (4) have dimensions such that, when the connection element (1) is coupled to the support panel (3) and the spherical element (1; 2) is housed in said seat (6) of the connection element (4), the geometric center of the spherical element (1; 2) substantially coincides, in a top view of the panel (3) with the vertex of at least one corner wherein said lateral slot (12) is fashioned.

20. The magnetic assembly according to claim 1, wherein said magnetic element (2) is a bar.

21. A magnetic assembly for creating three-dimensional structures, said magnetic assembly comprising at least one ferromagnetic element (1), at least one magnetic element (2), magnetically couplable to said at least one ferromagnetic element (1), and at least one support panel (3) having a perimeter edge (10) that delimits a prevalently flat surface having two opposing faces, wherein at least one portion of the perimeter edge (10) of said support panel (3) has a lateral slot (12) which is tangentially parallel to the flat surface of the support panel (3), wherein said magnetic assembly further comprises at least one connection element (4), said at least one connection element (4) comprising a seat (6) for removably housing and retaining a ferromagnetic element (1), and at least one peripheral portion (9) which is flat and suitable for being inserted into said lateral slot (12) of at least one portion of the perimeter edge (10) of said support panel (3), so that it is tangentially parallel to the flat surface of the support panel (3), and being removably coupled to it so that it is locked thereto, wherein said connection element (4) has a disc shape.

22. A magnetic assembly for creating three-dimensional structures, said magnetic assembly comprising at least one ferromagnetic element (1), at least one magnetic element (2), magnetically couplable to said at least one ferromagnetic element (1), and at least one support panel (3) having a perimeter edge (10) that delimits a prevalently flat surface having two opposing faces, wherein at least one portion of the perimeter edge (10) of said support panel (3) has a lateral slot (12) which is tangentially parallel to the flat surface of the support panel (3), wherein said magnetic assembly further comprises at least one connection element (4), said at least one connection element (4) comprising a seat (6) for removably housing and retaining a ferromagnetic element (1), and at least one peripheral portion (9) which is flat and suitable for being inserted into said lateral slot (12) of at least one portion of the perimeter edge (10) of said support panel (3), so that it is tangentially parallel to the flat surface of the support panel (3), and being removably coupled to it so that it is locked thereto, wherein said support panel (3) has a polygonal shape, and in that said lateral slot (12) is fashioned in at least one corner of said polygonal support panel (3);

wherein the lateral slot (12) of the support panel (3) and the peripheral portion (9) of the connection element (4) have dimensions such that, when the connection element (4) is coupled to the support panel (3), the geometric center of the element (1) housed in the connection element (4) substantially coincides, in a top view of the panel (3), with the vertex of the at least one corner of the panel (3) wherein said slot (12) is fashioned.

* * * * *